US011532905B2

(12) United States Patent
Remensperger

(10) Patent No.: US 11,532,905 B2
(45) Date of Patent: Dec. 20, 2022

(54) PLUG-IN DEVICE AND GOODS DISPLAY ARRANGEMENT

(71) Applicant: Shop Systems GmbH, Markdorf (DE)

(72) Inventor: Eugen Remensperger, Sigmaringendorf (DE)

(73) Assignee: Shop Systems GmbH, Markdorf (DE)

( * ) Notice: Subject to any disclaimer, the term of this patent is extended or adjusted under 35 U.S.C. 154(b) by 0 days.

(21) Appl. No.: 16/919,611

(22) Filed: Jul. 2, 2020

(65) Prior Publication Data

US 2021/0005996 A1 Jan. 7, 2021

(30) Foreign Application Priority Data

Jul. 4, 2019 (DE) ..... 10 2019 118 042.2

(51) Int. Cl.

| | |
|---|---|
| ***H01R 13/05*** | (2006.01) |
| ***H01R 13/62*** | (2006.01) |
| ***H01R 24/38*** | (2011.01) |
| ***H01R 24/86*** | (2011.01) |

(52) U.S. Cl.

CPC ..... *H01R 13/052* (2013.01); *H01R 13/6205* (2013.01); *H01R 24/38* (2013.01); *H01R 24/86* (2013.01)

(58) Field of Classification Search

CPC ..... H01R 24/86

See application file for complete search history.

(56) References Cited

U.S. PATENT DOCUMENTS

| | | | | |
|---|---|---|---|---|
| 2,926,327 | A | 2/1960 | Metelli | |
| 9,478,886 | B1 * | 10/2016 | Roberts | G06F 1/1681 |
| 9,509,074 | B2 * | 11/2016 | Otsuta | H01R 13/5219 |
| 2015/0244105 | A1 * | 8/2015 | Peng | H01R 13/6205 439/39 |

FOREIGN PATENT DOCUMENTS

| | | | |
|---|---|---|---|
| DE | 10 2006 037 119 | A1 | 2/2008 |
| DE | 102016 113 419 | A1 | 1/2018 |
| DE | 10 2016 121 435 | B3 | 3/2018 |
| EP | 2 789 272 | A1 | 10/2014 |

OTHER PUBLICATIONS

Extended European Search Report (Application No. 20183704.4) dated Oct. 13, 2020.

German Search Report (Application No. 10 2019 118 042.2) dated Nov. 8, 2021.

European Office Action dated May 9, 2022 (Application No. 20 183 704.4).

* cited by examiner

*Primary Examiner* — Ross N Gushi

(74) *Attorney, Agent, or Firm* — Burr & Brown, PLLC

(57) ABSTRACT

A plug-in device for an arrangement for goods display, having a socket mounted on a supporting structure, and a plug-in part having a plug-in portion plugged into a receptacle of the socket. An electrification arrangement, in the connected state of the plug-in device electrically supplies electricity via the plug-in device, with an electrical connection being established via the socket and the plug-in part in that an electrically conducting contact is established by galvanic contacting between a first contact point and a second contact point. The first contact point is formed on the socket and the second contact point is formed on the plug-in portion such that, in the connected state, the first contact point in and the second contact point are electrically contacted with one another.

14 Claims, 5 Drawing Sheets

PLUG-IN DEVICE AND GOODS DISPLAY ARRANGEMENT

This application claims the benefit under 35 USC § 119(a)-(d) of German Application No. 10 2019 118 042.2 filed Jul. 4, 2019, the entirety of which is incorporated herein by reference.

FIELD OF THE INVENTION

The present invention relates to a plug-in device and goods display arrangement.

BACKGROUND OF THE INVENTION

Plug-in devices having a socket on a supporting structure, such as, for example, a wall or a profiled element, and a plug-in part which fits into the socket, which socket and plug-in part can be releasably connected to one another, are used in various design forms. For example, plug-in devices serve to receive arrangements for the display of objects such as goods in sales areas or exhibition spaces, preferably on walls of the sales areas.

Here, very high demands are placed on the plug-in device in terms of functionality, engineering, appearance and assembly situation.

SUMMARY OF THE INVENTION

It is an object of the present invention to provide in an improved manner a plug-in device of the type described at the outset for an arrangement for goods display, more specifically a goods display plug-in device, in particular, with regard to the provision of a widened functionality of the plug-in device. The widened functionality of the plug-in device does not relate to a supporting property of the plug-in device. The widened functionality serves for the provision of increased use comfort of the plug-in device, for example, for an optically or visually improved goods display.

The present invention starts from a plug-in device for an arrangement for goods display, having a socket, which can be mounted on a supporting structure, and a plug-in part which is separate from the socket, the plug-in part having a plug-in portion which can be plugged into a receptacle of the socket in a plug-in direction along a plug-in axis until a connected state of the plug-in device is reached, with the result that, in the connected state, the plug-in part and the socket are releasably connected to one another, the plug-in portion having an end region and an outer lateral region, and the receptacle of the socket having an end region, which is situated at the front in the plug-in direction, and an inner lateral region, with, in the connected state, the lateral region of the plug-in portion and the lateral region of the receptacle coming into contact with one another. Additionally provided is an electrification arrangement in order, in the connected state of the plug-in device, to electrically supply an electrical load via the plug-in device, with, for electrical supply, an electrical connection being established via the socket and the plug-in part in that an electrically conducting contact is established by galvanic contacting between a first contact point of a contact portion of the electrification arrangement on the socket and a second contact point of a contact portion of the electrification arrangement on the plug-in portion.

In the present case, a contact point is understood, in particular, to mean a physical region which exists independently of whether a galvanic contact is or is not currently or effectively established therewith. Noncontacted regions, which are thus, for example, temporarily galvanically isolated, are therefore also referred to as contact points.

The socket has, in particular, a portion for mounting the socket on the supporting structure. This portion can, for example, take the form of through-holes in, for example, a flange portion of the socket for screw means engaging therethrough for the purpose of screwing the socket on a rear wall of a wall element or of a profiled rail. The receptacle provides an open cavity for plugging in, with the receptacle, in the installed situation in which it is mounted on the supporting structure, being accessible or open from a plug-in side for mounting the plug-in part. For example, given a regular rear-side wall mounting of the socket, the receptacle is freely accessible from the front or visible side of the wall via a prepared hole in a corresponding wall element, which hole is, for example, aligned with an opening of the receptacle that is present at the front, with the remaining portions of the socket being concealed by the wall element.

The receptacle preferably has the lateral region or a wall portion which radially delimits the receptacle with respect to the plug-in direction, with an axial length according to the length of the plug-in portion. The lateral region is preferably designed to taper in the plug-in direction, this relating to the inner side of a socket wall of the socket. The socket wall can on the outside be designed to project away rearwardly on the flat flange portion of the socket, for example, can be designed on the outside to be sleeve-shaped, for example, cylindrical.

The plug-in portion preferably comprises an outer-side lateral region which is tailored to the lateral region of the socket, with the lateral region of the receptacle and the lateral region of the plug-in portion, or at least substantial regions thereof, coming into areal contact with one another in the connected state of the plug-in device, with the result that a fixed state of retention of the plug-in part on the socket is established via the areal contact. It is thus advantageously possible for comparatively large retaining forces to be compactly realized in the connected state of plug-in part and socket.

The lateral region of the receptacle that is present on the inner side of the socket is designed to taper in the plug-in direction, preferably designed to taper conically. In a corresponding manner to the conicity of the socket lateral region, the outer-side lateral region of the plug-in part is likewise configured to taper conically.

The lateral region of the receptacle preferably at least substantially takes the form of a rectilinear truncated cone, as does the lateral region of the plug-in portion.

An anti-rotation safeguard which acts between the socket and the plug-in part is also preferably configured to avoid a rotational movement of the plug-in part about the plug-in axis of the plug-in part in the connected state of the plug-in device.

The core of the present invention consists in the fact that the first contact point is formed on the socket in the lateral region of the receptacle, and that the second contact point is formed on the plug-in portion in the lateral region of the plug-in portion, with the result that, in the connected state, the first contact point in the lateral region of the socket and the second contact point in the lateral region of the plug-in portion are electrically contacted with one another.

An electrical contact means that galvanic contacting of the two contact points is established.

An arbitrary electrical load on the plug-in part can thus be advantageously electrically supplied via the plug-in device, said electrical load being, for example, an electrical illuminating device or lighting arrangement for illuminating and lighting a goods display region in which goods are or can be presented. This increases the functionality of the plug-in device in terms of the optically advantageous goods display.

In the connected state, provided that an electrical supply of the contact portion of the socket takes place, for example, from outside via a power network, it is possible for the contact portion of the plug-in part to be electrified. Leading from there is, for example, an electrical connection line to the load. Switching means for switching, or, for example, for manually switching on and off, the electrical supply of the electrical load are preferably provided on the plug-in device or the goods display arrangement and/or outside.

The first contact point and the second contact point are preferably adjacent to one another in the radial direction with respect to the plug-in axis. The first contact point and the second contact point have, for example, a distance of, for example, 2, 5 or 10 millimeters from the respective end region of the socket base and a free end of the plug-in portion.

Advantageously, the contact portion of the electrification arrangement on the socket has two spaced-apart first contact points, and the contact portion of the electrification arrangement on the plug-in portion has two spaced-apart second contact points, a first contact point and a second contact point, which are connected to one another, belonging to a common electrical pole. The contact portion on the socket is preferably formed by two separated components, as is the contact portion on the plug-in portion, with, for example, the respective contact portion being formed by two strip-shaped metal platelets.

In the connected state, the two first contact points are preferably in galvanic contact with an associated second contact point such that a two-pole electrical supply can be established. With respect to a central longitudinal axis of the plug-in device or with respect to the plug-in axis, the contact points are preferably situated opposite one another or radially opposite one another, preferably at the same axial height or in a common axial plane.

It is also advantageous for an outwardly open opening to be present in the lateral region of the receptacle, with, in the connected state of the plug-in device, the galvanic contacting of the first contact point with the second contact point being established via the opening. The opening is present in the lateral region of the receptacle or an associated wall portion which encloses the receptacle.

The receptacle with its receiving volume for the plug-in portion is preferably pot-like or open to the front according to a front axial opening for plugging in the plug-in portion. Rearwardly, or axially opposite to the front axial opening, the receptacle is preferably closed by a socket base or pot base. The opening comprises only a comparatively small opening area. The opening is preferably formed over an axial partial length of the wall portion and over a partial circumference of, for example, 10 to 30 angular degrees. Two radially opposite openings are preferably present in the lateral region or in the associated wall portion for the different electrical poles or contactings of different polarities.

An advantageous variant consists in the socket having a socket base which is oriented axially with respect to the plug-in axis, the socket base being at least substantially closed. It is thus possible for the socket to be produced in a simple manner. In addition, the receptacle of the socket, into which the plug-in portion can be plugged, is protected against penetration of dirt or moisture into the receptacle from a rear side of the socket in the mounted state or from regions behind the supporting structure, such as the supporting wall.

The socket base closes the sleeve-shaped wall portion to the rear or on the rear side or against the plug-in side. In the region of the socket base, no galvanic contacting or no electrically conducting feeding or connection takes place or no electrical line contact for electrical supply is provided. The socket base is preferably completely or at least substantially closed. By way of the socket base, the receptacle of the socket is designed to be closed at its end situated at the front in the plug-in direction. It is advantageously possible for there to be accommodated in the region of the socket base, for example, a permanent magnet for the socket-side retention of the plug-in portion which is magnetic in relation thereto.

According to another advantageous embodiment, the opening in the lateral region of the receptacle is spaced apart from the socket base in the direction of the plug-in axis. Protected contacting is thus possible. The opening, which is present, for example, in rectangular form in the cylindrical wall portion, is, for example, spaced apart from the socket base via a closed region of the wall portion.

A further advantage lies in the fact that the plug-in portion has on its outer side a depression which is recessed with respect to portions of the outer side of the plug-in portion that adjoin the depression, the contact portion being present on the plug-in portion within the depression. The contact portion has the second contact point. The contact portion of the plug-in portion is preferably present on a plug-in part plug element. The contact portion of the plug-in portion and the plug-in part plug element, preferably together or jointly, for example, configured as a plug member which is received in the depression, are, for example, retained in an easily fixed manner on walls of the depression by frictional effects and/or retained by magnetic forces of magnet means of the plug-in device. The depression and the contact portion with the plug-in part plug element are preferably tailored in such a way that the contact portion and the plug-in part plug element do not project with respect to an envelope surface of the plug-in portion or do not project on the, for example, conical lateral surface of the plug-in portion.

The embedded or recessed accommodation of the contact portion allows a compact and protected design of the electrification arrangement or of the second contact point. The depression is, for example, configured as a narrow elongate groove in the longitudinal direction of the plug-in portion that is formed in a width dimension of the depression over a small partial circumference of, for example, 30 to 50 or 40 angular degrees. The length of the depression is, for example, about half the length of the plug-in portion. The depression is, for example, open in the plug-in direction or to the rear in the direction of a free end of the plug-in portion. To the front, the depression preferably extends as far as an opening in the plug-in portion, such as, for example, a transverse bore. The opening is preferably open to or connected to a cavity, such as, for example, a longitudinal bore, in a mounting portion of the plug-in part.

The opening in the plug-in portion extends up to close to the beginning of the plug-in portion or up to into the region where the plug-in portion extends up to a mounting portion of the plug-in part. The mounting portion can have an extension mounted thereon that is part of the arrangement for goods display.

According to an advantageous modification of the present invention, the plug-in part has a cavity which is designed to receive an electrical line. The cavity is formed, for example, by a central longitudinal bore which serves for receiving an electrical conductor for line routing from the contact portion on the plug-in portion to a front free end of the plug-in part. The conductor in the cavity thus extends, protectively accommodated within the plug-in part, from the contact portion on the plug-in portion up to an open end of the plug-in portion. From there, an electrical connection up to an electrical load of the goods display arrangement can be established, for example, via a cable extension.

It is possible, for example, for an outwardly electrically insulated multicore cable to be routed through the bore.

The cavity serves for the protected space-saving reception of an electrically conducting bridging over a substantial length of the plug-in part, in particular, over a partial length of the plug-in portion and over preferably the entire length of the mounting portion.

The cavity preferably has a central clearance or bore which is axially open at the front end of the mounting portion, that is to say the end which faces away from the plug-in portion.

At its other or inner end, the cavity is open to the opening up to which the depression in the plug-in portion extends. There is, thus, provided a continuous inner connecting space between the contact portion on the plug-in portion and a free end of the mounting portion on the plug-in part, that is to say toward the side of the goods display arrangement.

The opening preferably passes completely through the plug-in portion and is, for example, oriented transversely with respect to the longitudinal bore. The opening extends up to outwardly spaced-apart or separated opening outlets on the outer side of the plug-in portion. Since the opening is connected to the cavity, the opening outlets are, for example, present at radially opposite points on the outside or form points which are open on both sides on the plug-in portion outer side. Apart from the two opening outlets on the plug-in portion and the axially open side of the mounting portion, the cavity is preferably closed.

The contact portion of the electrification arrangement on the plug-in portion is advantageously connected to the electrical line which is received in the cavity of the plug-in part. This allows the electrical through-conduction over a partial length of the plug-in part. The galvanic contact between the contact portion and the electrical line is preferably established by means, for example, of a solder connection or by means of a releasable plug contact.

The contact portion of the electrification arrangement can advantageously be plugged on a plug element. The contact portion on the socket and the contact portion on the plug-in portion are preferably releasably inserted on a respective associated plug element.

Another advantageous embodiment provides for the contact portion of the electrification arrangement on the socket to be present on a socket plug element, the socket plug element consisting of an electrically insulating material. An electrical insulation of the socket contact portion with respect to the socket can thus be established. The socket contact portion is formed, for example, from a thin metal platelet which can be inserted into a seat on the socket plug element that is fittingly tailored to the shape and size of the contact portion or of the metal platelet. The socket contact portion is preferably latchingly connected to the socket plug element via a releasable latching connection.

The socket contact portion is preferably formed from a spring steel. The socket contact portion preferably has a resiliently formed spring portion in such a way that the socket plug element can be latched with the contact portion by means of the spring portion, which projects on the socket plug element, as a result of the spring portion snapping resiliently into a contour or clearance on the socket plug element. The first contact point is preferably likewise formed on a resilient portion, whereby a preloading is provided via which there can advantageously be established a secure galvanic contacting between the first contact point and the second contact point which belongs to the contact portion on the plug-in portion. This occurs when the plug-in part and the socket are in the connected state.

The socket preferably consists of a metal material, such as, for example, a casting. The socket plug element, which is part of the electrification arrangement, consists, for example, of a plastics material. The socket plug element with the contact portion can be plugged on the socket. Provided on the outside of the socket is an insertion contour for inserting the socket plug element. The socket plug element can preferably be mounted on the socket by means of a sliding fit. The first contact portion is, as a result of being received in the socket plug element, electrically insulated with respect to the metallic socket when the socket plug element is mounted on the socket. When the first contact portion is electrically energized, the socket remains current-free.

The first contact portion can preferably be releasably inserted on the socket plug element. The socket plug element has, with respect to the state in which it is mounted on the socket, an end-side opening or open side, preferably a side which is open axially on the rear side. An electrically conducting connection of the first contact portion, for example, via an electrical supply line, such as a cable of a power network, which extends up to the socket occurs via the open side from outside, for example, on the rear side with respect to the supporting structure. The cable preferably extends through the open side and is electrically conductingly connected to, for example, soldered on, the contact portion by way of at least one conducting core of the cable.

In order to provide a separated two-pole electrical supply, the socket is provided with two recesses for a respectively fittingly insertable socket plug element with a respective contact portion.

According to a preferred variant, the contact portion of the electrification arrangement on the plug-in part is present on a plug-in part plug element, the plug-in part plug element consisting of an electrically insulating material. With respect to the plug-in part, which preferably consists of a metal material, the plug-in part plug element is a separate component which can preferably be fittingly inserted thereon. In order to provide a separated two-pole electrical supply, the plug-in portion is provided with two depressions for a respectively fittingly insertable plug-in part plug element.

The plug-in part contact portion is formed, for example, from a thin metal platelet which can be inserted into a seat on the plug-in part plug element that is fittingly tailored to the shape and size of the contact portion. The plug-in part contact portion is preferably latchingly connected to the plug-in part plug element via a releasable latching connection.

The plug-in part plug element and the depression on the outer side of the plug-in portion are designed to be tailored to one another in such a way that the plug-in part plug element is received in the depression such that it can be completely or at least virtually completely sunk therein. An edge of the plug-in part plug element preferably extends up to an outer side of the plug-in portion or projects slightly thereon. The contact portion of a plug-in part plug element on the plug-in part between opposite edges of the plug-in part plug element is preferably present so as to lie somewhat deeper with respect to the respective outer side of the edges. The contact portion is preferably formed from a, for example, strip-shaped metal platelet having an angularly inwardly bent-over end face. In the inserted state of the plug-in part plug element, the bent-over end face extends radially somewhat inwardly into a region of the opening or of the cavity of the plug-in portion. An electrical line is preferably connected to the bent-over end face, for example, a core of an electrical cable line is soldered on.

A further advantage is afforded by the fact that the first contact point and/or the second contact point are/is designed as a resilient contact point. The first contact point and/or the second contact point are/is preferably present on a resilient portion of the relevant contact portion. A secure galvanic connection between the two contact points is thus ensured by means of an acting spring preloading.

Finally, it is advantageous that a positioning arrangement is formed which acts between the receptacle of the socket and the plug-in portion of the plug-in part, with the result that a predefined position between the plug-in portion of the plug-in part and the socket is established in the circumferential direction with respect to the plug-in axis. It is thus possible to establish the connected state of the plug-in device only in precisely one circumferential relative position of socket and plug-in part. This makes it possible to avoid an incorrect polarity of the electrical connection or supply of the electrical load that can be established with the electrification arrangement. It is thus possible, in particular, for risk situations and/or an electrical short circuit or damage, for example, to a transformer of the electrification arrangement to be ruled out.

The positioning arrangement is formed separately or preferably in combination with the anti-rotation safeguard. The positioning arrangement or the anti-rotation safeguard comprises, for example, a securing contour which is formed between the lateral region of the receptacle and the lateral region of the plug-in portion. The securing contour comprises, for example, a first and a second groove, which differ in terms of width, preferably in or on the outside of the lateral region of the plug-in portion, and precisely two elevations, which fit in position with the grooves, on the otherwise conical wall of the receptacle, with a first elevation on the lateral region of the socket, which fittingly engages in the first groove in the connected state, and with a second elevation on the socket, which fittingly engages in the second groove in the connected state. The plug connection in the connected state of socket and plug-in part is possible only in precisely one relative rotational position of socket and plug-in part, whereby electrification with the correct polarity is ensured.

It is moreover advantageous that magnet mechanisms are provided for increasing a retaining force in the connected state of the plug-in device.

Magnet mechanisms, in particular, permanent magnets mounted on the socket and on corresponding portions of the plug-in part, can be used to increase the retaining force in the connected state in a problem-free and uncomplicated manner. In particular, it is advantageous that the magnet mechanism comprise a first magnet part in a region of the plug-in portion that is at the end side in the plug-in direction, and a second magnet part on a base of the receptacle that is provided with an opposite polarity to the magnet polarity of the first magnet part.

Finally, the present invention extends to an arrangement for goods display having a plug-in device according to one of the above-described embodiments. The goods display arrangement can, thus, advantageously be provided with an electrical load which can be electrically supplied via the plug-in device in a secure and space-saving manner while being inconspicuous or not visibly apparent from outside. The electrical load is, for example, part of an illuminating device for illuminating the presented goods, for example, having a lighting mechanism, such as, for example, a LED lighting mechanism.

Part of the goods display arrangement can preferably be mounted or fastened on the mounting portion of the plug-in part.

BRIEF DESCRIPTION OF THE DRAWINGS

Further features and advantages of the present invention are explained below with reference to the exemplary embodiments.

DETAILED DESCRIPTION OF THE INVENTION

Figure 1:
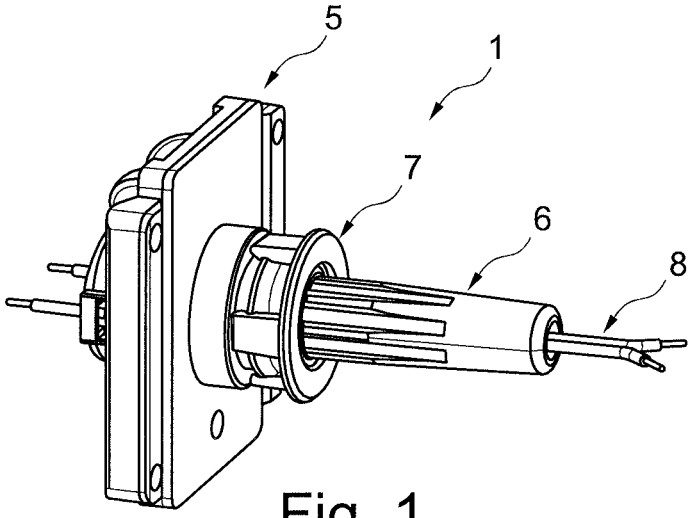
FIG. 1 shows a perspective view obliquely from above of a plug-in device according to the invention in an installed orientation.
Figure 2:
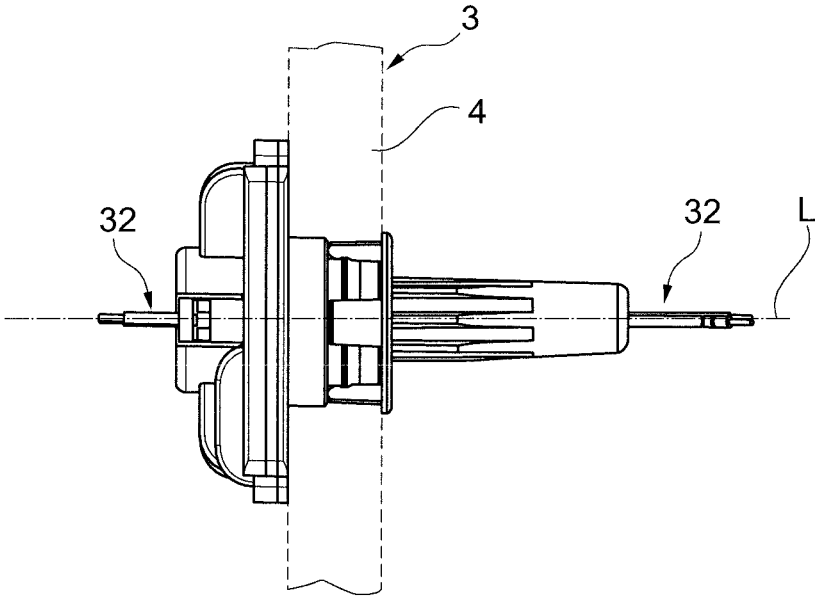
FIG. 2 shows the plug-in device according to FIG. 1 from the side on a supporting structure which is partially indicated with dashed lines.
Figure 3:
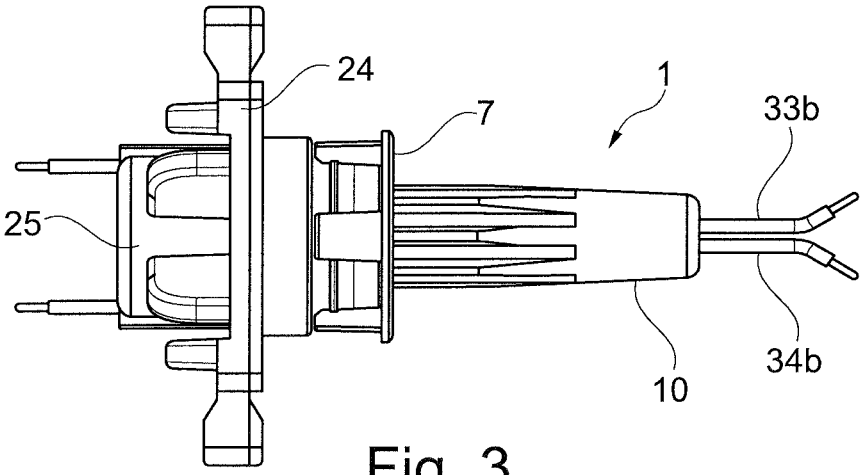
FIG. 3 shows the plug-in device according to FIG. 1 from above.

FIG. 1 shows a plug-in device 1 according to the invention in a connected state. The plug-in device 1 can be anchored on a supporting structure 3, such as, for example, a wall element 4 (see FIG. 2) or a profiled rail. The plug-in device 1, which is provided for a unit or arrangement 2 for goods display (see FIG. 7), comprises a socket 5 which can be mounted on the supporting structure 3, a plug-in part 6 separate from the socket 5, a plug-on ring 7 and an electrification arrangement 8.

The plug-in part 6 has a plug-in portion 9 and a mounting portion 10, the plug-in portion 7 being able to be plugged into a cavity-forming receptacle 11 of the socket 5 in a plug-in direction P1 along a plug-in axis L until the connected state of the plug-in device 1 is reached. In the connected state, the plug-in part 6 and the socket 5 are releasably connected to one another, with a comparatively high retaining force acting against release of the plug-in part 6 completely plugged in on the socket 5. A socket base 5*a* of the socket 5 is closed.

The plug-in portion 9 comprises an end region 12 and an outer lateral region 13 which are present within the receptacle 11 in the connected state. The hollow receptacle 11 of the socket 5 also has an end region 14, which is situated at the front in the plug-in direction P1, and an inner lateral region 15. In the connected state, the lateral region 13 of the plug-in portion 9 and the lateral region 15 of the receptacle come into contact with one another. The lateral regions 13 and 15 are preferably designed as cone surfaces which are fittingly tailored to one another. In the connected state, these or the respective surfaces of the lateral regions 13 and 15 come into areal contact. The cone surfaces of the lateral regions 13 and 15 that are situated mutually in contact with or in abutment on one another in the connected state provide a best possible or optimized form-fitting engagement. This results in a connection of plug-in part 6 and socket 5 with optimized stability or with optimized play in combination with a high retaining force between plug-in part 6 and socket 5.

Figure 11:
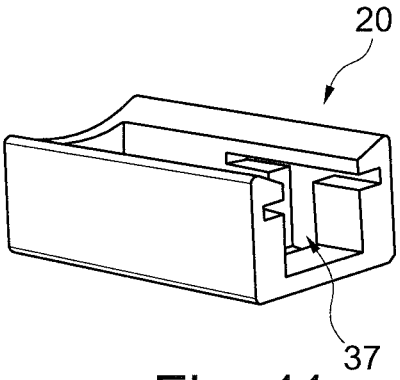
FIG. 11 shows in perspective the socket plug element according to FIG. 10 in a further view.
Figure 11A:
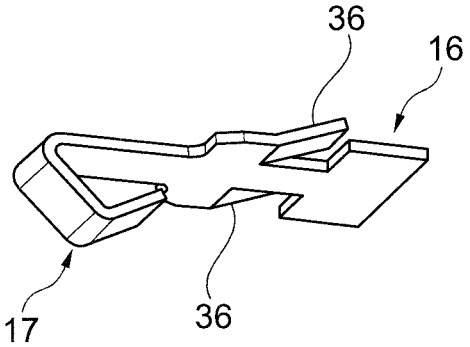
FIG. 11*a* shows a contact portion which can be plugged on the socket plug element according to FIGS. 10 and 11.
Figure 15:
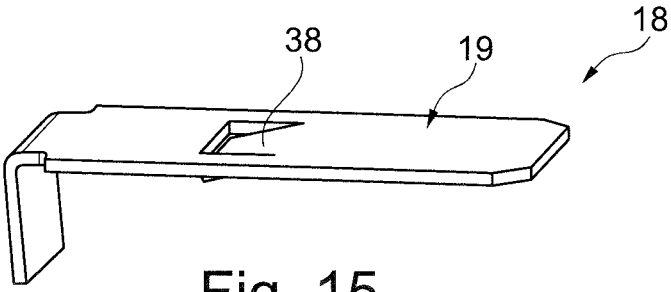
FIG. 15 shows a contact portion of the plug-in part, which contact portion can be plugged on the plug-in part plug element according to FIGS. 13 and 14.

An electrical load 40, such as, for example, an illuminating member 41, in the vicinity of the plug-in device 1 (see FIG. 7) or on the arrangement 2 for goods display is electrically supplied by means of the electrification arrangement 8 with the plug-in device 1 in the connected state. There is here established an electrical connection of a part of the electrification arrangement 8 present on the socket 5 and of a part of the electrification arrangement 8 present on the plug-in part 6. For this purpose, there exists an electrically conducting contact by galvanic contacting between a first contact point 17 of a contact portion 16 (see FIG. 11*a*) of the electrification arrangement 8 on the socket 5 and a second contact point 19 of a contact portion 18 (see FIG. 15) of the electrification arrangement 8 on the plug-in portion 9 or of the plug-in part 6.

Figure 10:
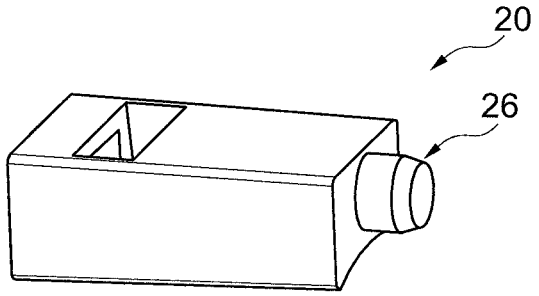
FIG. 10 shows a socket plug element of the plug-in device according to FIGS. 1 to 8 in perspective from the side.

The contact portion 16 on the socket 5, which contact portion is formed from an electrically conducting material, such as, for example, a steel material, is releasably but lockably received on a socket plug element (see FIGS. 10, 11) consisting of an electrically nonconducting material, such as, for example, a plastics material.

Figure 13:
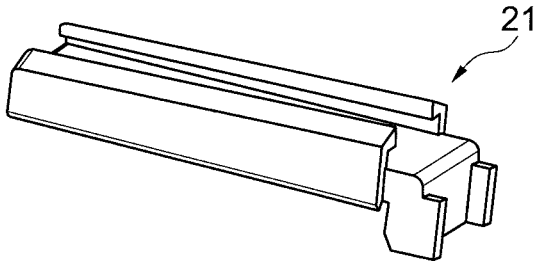
FIG. 13 shows a plug-in part plug element of the plug-in device according to FIGS. 1 to 8 from the side in perspective obliquely from above.
Figure 14:
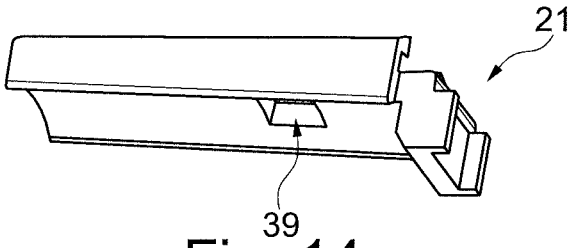
FIG. 14 shows the plug-in part plug element according to FIG. 13 from the side in perspective obliquely from below.

The contact portion 18 on the plug-in portion 9, which contact portion is formed from an electrically conducting material or a steel material, is also releasably but lockably received on a plug-in part plug element 21 (see FIGS. 13, 14) consisting of an electrically nonconducting material.

Figure 9:
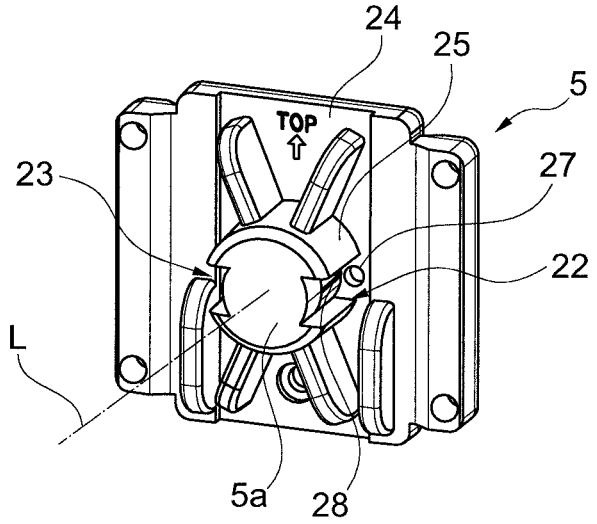
FIG. 9 shows a socket of the plug-in device according to FIGS. 1 to 8 in a perspective rear view obliquely from above.

FIG. 9 shows the socket 5, which consists, for example, of a one-piece metallic casting and is part of a plug-in device according to the invention. The associated contact portion 16 can be mounted with a socket plug element 20 on the socket 5.

For this purpose, two recesses 22, 23 which are situated radially opposite one another with respect to the plug-in axis L are formed on the socket 5 on a wall 25 of the socket 5 that projects on the rear side on a flange portion 24 of the socket 5. The recesses 22, 23 are each configured to be fittingly tailored to the socket plug element 20. It is thereby possible for two socket plug elements 20 with a respective contact portion 16 present thereon to be plugged on the socket 5. In the plugged state of the socket plug elements 20, the latter are fastened to the socket 5 in a self-retaining manner by means, for example, of frictional effects. A peg 26 on the two socket plug elements 20 that projects on the end side engages frictionally in a corresponding respective bore 27 in the flange portion 24.

The wall 25 forms on the inner side the lateral region 15 of the receptacle 11. Each recess of the recesses 22, 23 respectively forms an opening 28, 29 in the wall 25 and thus in the lateral region 15. A portion of the respective contact portion 16 engages through each opening 28, 29, with the through-engaging portion having the contact point 17. Consequently, the two contact portions 16 provide two different electrical poles with or on the contact points 17 which are assigned to that part of the electrification arrangement 8 which is present on the socket 5. With respect to the plug-in axis L, the two contact points 17 project radially inwardly toward the lateral region 15 of the receptacle 11 or are situated radially further inward than the lateral region 15 at radially opposite positions within the receptacle 11. There, the contact points 17 each come into contact with the respectively associated contact point 19 of the relevant contact portion 18 on the plug-in portion 19.

Figure 4:
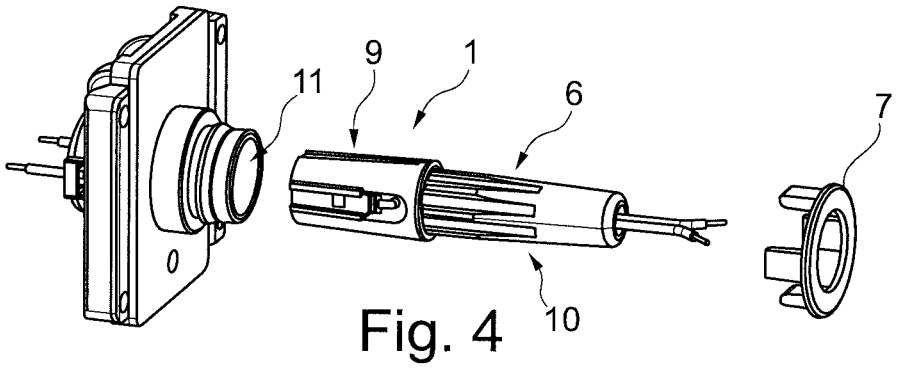
FIG. 4 shows the plug-in device according to FIG. 1 in an exploded illustration.
Figure 5:
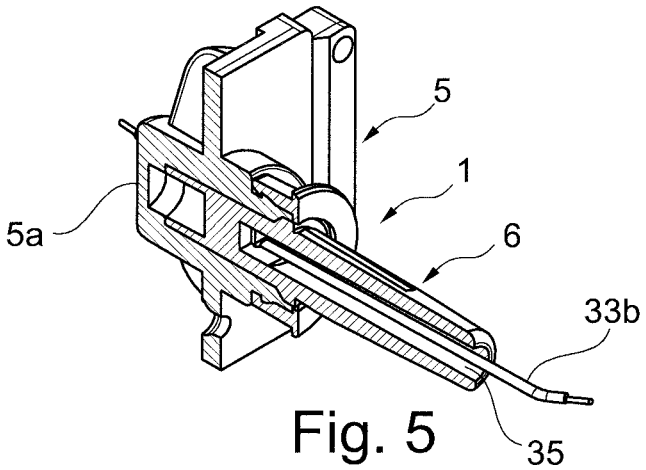
FIG. 5 shows the plug-in device in perspective obliquely from above in a central longitudinal section with a section plane parallel to the vertical.
Figure 6:
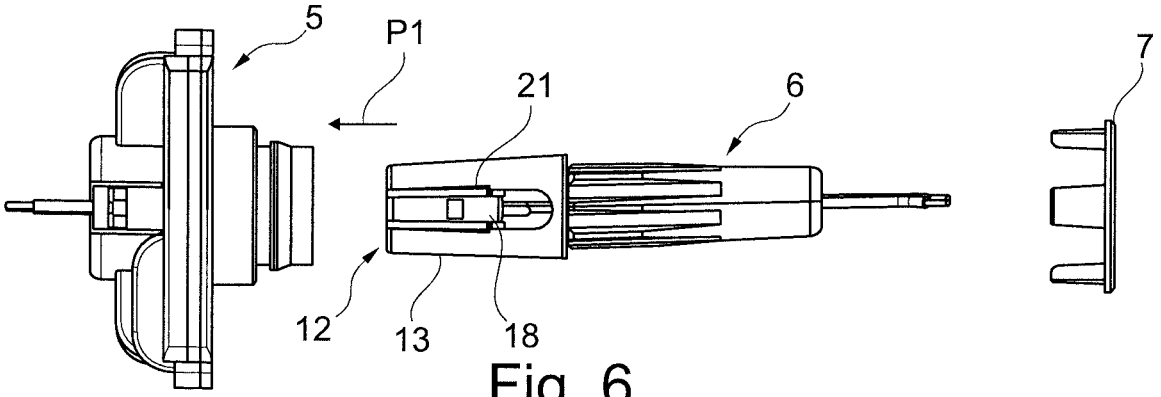
FIG. 6 shows the plug-in device according to FIG. 4 from the side.

For the respective contact portions 18 with the plug-in part plug element 21 on the plug-in portion 9, two radially opposite depressions 30 and 31 are formed in the lateral region 13 or on an outer side of the plug-in portion 9. The depressions 30, 31 are each configured to be fittingly tailored to the plug-in part plug element 21. It is thus possible for two plug-in part plug elements 21 with a respective contact portion 18 present thereon to be plugged or inserted on the plug-in part 6 or the plug-in portion 9. In the inserted state of the plug-in part plug elements 21 (see FIGS. 4, 6), the latter are fastened on the plug-in portion 9 in a self-retaining manner.

Figure 8:
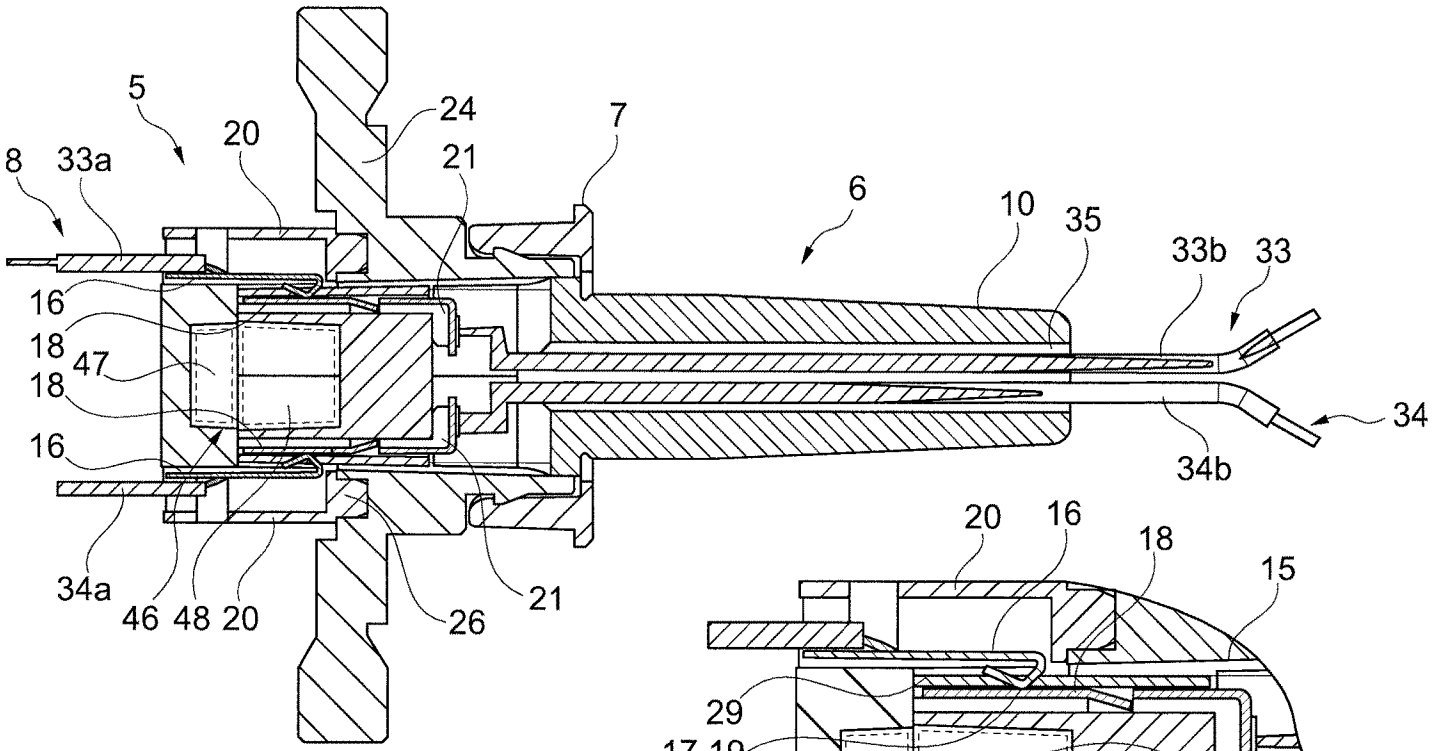
FIG. 8 shows the plug-in device according to FIG. 3 in a longitudinal section with a section plane parallel to the horizontal, with a magnet arrangement being indicated.
Figure 8A:
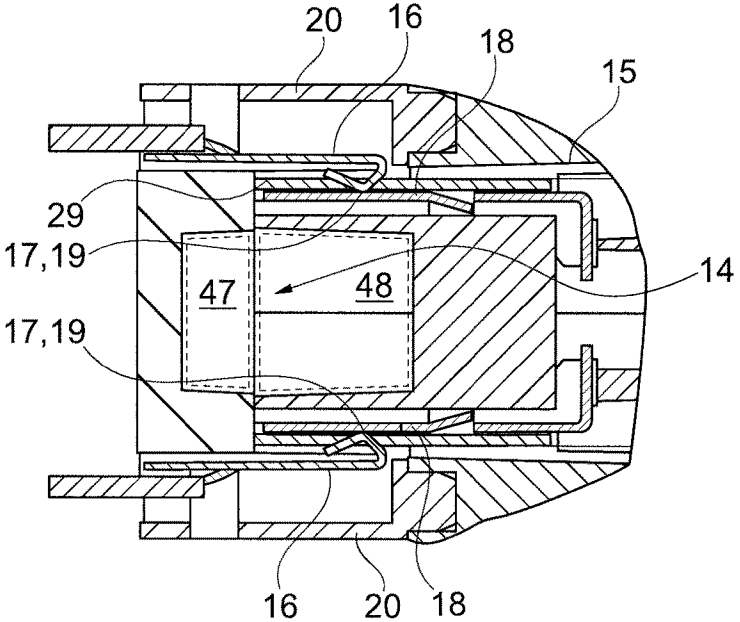
FIG. 8*a* shows an enlarged detail of FIG. 8.

As illustrated in particular in FIG. 8 and FIG. 8*a*, in the connected state the first contact point 17 in the lateral region of the socket 5 and the second contact point 19 in the lateral region of the plug-in portion 9 are in electrical contact with one another.

The electrification arrangement 8 additionally comprises an electrical cable line 32, such as a cable line having two line cores 33 and 34, with the line cores 33 and 34 serving to provide different electrical poles or an electrical plus pole and an electrical minus pole. A partial length 33*a* of the line core 33 leads via the rear side of the supporting structure 3 from an electrical supply (not shown) to one of the two socket-side contact portions 16. A conducting wire, which is outwardly insulated apart from its ends, of the partial length 33*a* of the line core 33 is galvanically connected to, for example, soldered on, this contact portion 16. In addition, a partial length 34*a* of the line core 34 leads via the rear side of the supporting structure 3 from the electrical supply to the other of the two socket-side contact portions 16. A conducting wire of the partial length 34*a* of the line core 34 is galvanically connected to, for example, soldered on, this contact portion 16.

The electrically conducting connection via the respective pairs of the contact points 17 and 19 is continued up to a partial length 33*b* of the line core 33 and a partial length 34*b* of the line core 34. The partial lengths 33*b* and 34*b* lead from a free end of the mounting portion 10 through a central cavity 35 of the plug-in part 6 up to a respectively associated contact portion 18 of the two plug-in portion-side contact portions 18. A conducting wire of the partial length 34*a* of the line core 34 is galvanically connected to, for example, soldered on, one contact portion 18. A conducting wire of the partial length 33*b* of the line core 33 is galvanically connected to, for example, soldered on, the other contact portion 18.

For the releasable, for example, resilient, latching of the contact portion 16 on the socket plug element 20, the contact portion 16 has two spring tabs 36 which are bent over on a strip plate and which latch in a contour 37 on the socket plug element 20 in the functionally correct insertion state of the contact portion 16 on the socket plug element 20.

Correspondingly, for releasable, for example, resilient, latching of the contact portion 18 on the plug-in part plug element 21, the contact portion 18 has a spring tab 38 which is bent over on a strip plate and which latches in a contour 39 on the plug-in part plug element 21 in the functionally correct insertion state of the contact portion 18 on the plug-in part plug element 21.

Figure 7:
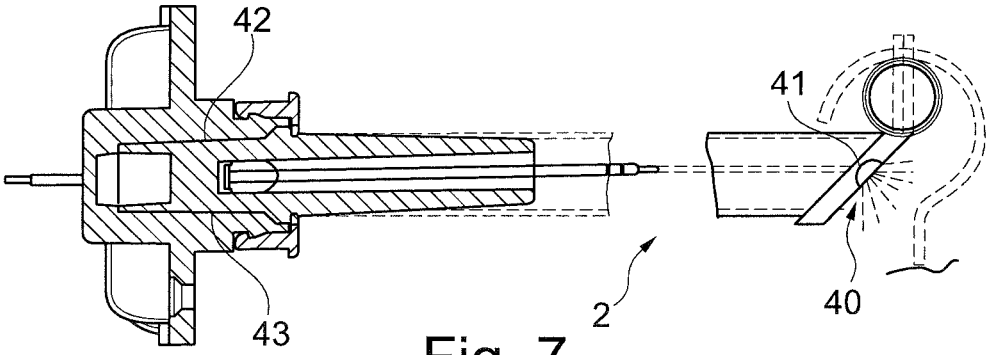
FIG. 7 shows the plug-in device according to FIG. 5 from the side in addition with an arrangement for goods display that is arranged thereon which is indicated in interrupted fashion and partially in outlines.
Figure 12:
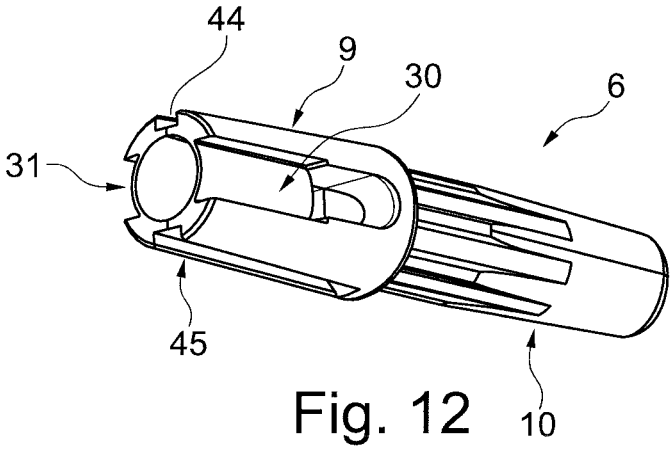
FIG. 12 shows a plug-in part of the plug-in device according to FIGS. 1 to 8 in perspective obliquely from the side.

For anti-rotation safeguarding and for polarity-correct electrical connection of the socket side of the plug-in device 1 and the plug-in part side of the plug-in device 1, there are provided opposite one another two elongate webs 42, 43 which extend in the direction of the plug-in axis L, are quadrangular in section and project inwardly in the lateral region of the receptacle 11 (see FIG. 7). The two webs 42, 43 have a different width from one another. In corresponding width or orientation and position, two grooves 44 and 45 each having a different width are formed on the outside in the lateral region of the plug-in portion 9 (see FIG. 12).

In order to further increase a retaining force in the connected state of the plug-in device 1, a magnet arrangement 46 is additionally provided (see FIGS. 8, 8*a*). The magnet arrangement 46 comprises magnet mechanisms with a permanent magnet 47 assigned to the socket 5 or, for example, adhesively bonded therein in a blind hole bore, and a further permanent magnet 48 which is assigned to the plug-in part 6 and which is likewise fixedly mounted in a blind hole bore at the end side on a front end or the end region 12 on the plug-in portion 9. The magnet arrangement 46 is indicated in FIGS. 8 and 8*a*, the outlines of the permanent magnets 47 and 48 being illustrated in dashed lines. The magnetic pole of the permanent magnet 47 is opposite to the magnetic pole of the permanent magnet 48, with the result that, in the connected state, the permanent magnets 47 and 48 are in attracting contact with one another or are spaced apart by way of a comparatively very small gap with, for example, a gap distance of less than one millimeter.

The attracting force on the plug-in part 6 in the plug-in direction P1 provided by the magnet arrangement 46 acts on the end side of the plug-in part 6, whereby, in addition to the existing form-fitting or frictional connection, the plug-in part 6 is held fixedly in the socket 5 via the magnetic force provided by the permanent magnets 47 and 48.

LIST OF REFERENCE SIGNS

1 Plug-in device
2 Arrangement
3 Supporting structure
4 Wall element
5 Socket
5*a* Socket base
6 Plug-in part
7 Plug-on ring
8 Electrification arrangement
9 Plug-in portion
10 Mounting portion
11 Receptacle
12 End region
13 Lateral region
14 End region
15 Lateral region
16 Contact portion
17 Contact point
18 Contact portion
19 Contact point
20 Socket plug element
21 Plug-in part plug element
22 Recess
23 Recess
24 Flange portion
25 Wall
26 Peg
27 Bore
28 Opening
29 Opening
30 Depression
31 Depression
32 Cable line
33 Line core
33*a* Partial length
33*b* Partial length
34 Line core
34*a* Partial length
34*b* Partial length
35 Cavity
36 Spring tab
37 Contour
38 Spring tab
39 Contour
40 Load
41 Illuminating member
42 Web
43 Web
44 Groove
45 Groove
46 Magnet arrangement
47 Permanent magnet
48 Permanent magnet

The invention claimed is:

1. A plug-in device for an arrangement for a goods display, the plug-in device comprising:

a socket having a receptacle and adapted to be mounted on a supporting structure; and a plug-in part, separate from the socket, and having a plug-in portion adapted to be plugged into the receptacle of the socket in a plug-in direction along a plug-in axis until a connected state of the plug-in device is reached, wherein, in the connected state of the plug-in device, the plug-in part and the socket are releasably connected to one another, wherein the plug-in portion has an end region and an outer lateral region, wherein the receptacle of the socket has an end region, situated at a front of the socket in the plug-in direction, and an inner lateral region, wherein, in the connected state of the plug-in device, the outer lateral region of the plug-in portion and the inner lateral region of the receptacle contact one another, wherein an electrification arrangement is provided to electrically supply an electrical load via the plug-in device in the connected state of the plug-in device, so that an electrical connection is established via the socket and the plug-in part, wherein an electrically conducting contact is established by galvanic contact between a first contact point of a first contact portion of the electrification arrangement on the socket and a second contact point of a second contact portion of the electrification arrangement on the plug-in portion, wherein the first contact point is formed on the socket in the inner lateral region of the receptacle, and wherein the second contact point is formed on the plug-in portion in the outer lateral region of the plug-in portion, whereby, in the connected state of the plug-in device, the first contact point in the inner lateral region of the socket and the second contact point in the outer lateral region of the plug-in portion electrically contact one another, wherein the first contact portion of the electrification arrangement on the socket has two first contact points that are spaced apart from one another, and the second contact portion of the electrification arrangement on the plug-in portion has two second contact points that are spaced apart from one another, wherein the two first contact points are respectively connected to the two second contact points, and wherein each of the first and second contact points have the same electrical polarity, wherein the respective contact points are situated radially opposite to one another with respect to a central longitudinal axis of the plug-in device or with respect to the plug-in axis, and wherein an outwardly open opening is present in the inner lateral region of the receptacle, whereby, in the connected state of the plug-in device, the galvanic contact between the first contact point and the second contact point is established via the opening.

2. The plug-in device as claimed in claim 1, wherein the socket has a socket base oriented axially with respect to the plug-in axis, and wherein the socket base is at least substantially closed.

3. The plug-in device as claimed in claim 2, wherein an opening in the inner lateral region of the receptacle is spaced apart from the socket base in the direction of the plug-in axis.

4. The plug-in device as claimed in claim 1, wherein the plug-in portion has a depression on an outer side thereof, wherein the depression is recessed with respect to other portions of the outer side of the plug-in portion adjacent to the depression, and wherein the second contact portion of the electrification arrangement on the plug-in portion is present within the depression.

5. The plug-in device as claimed in claim 1, wherein the plug-in part has a cavity adapted to receive an electrical line.

6. The plug-in device as claimed in claim 5, wherein the second contact portion of the electrification arrangement on the plug-in portion is connected to the electrical line received in the cavity of the plug-in part.

7. The plug-in device as claimed in claim 1, wherein the first contact portion of the electrification arrangement on the socket can be plugged on a plug element.

8. The plug-in device as claimed in claim 7, wherein the first contact point of the first contact portion of the electrification arrangement on the socket is present on a socket plug element, and wherein the socket plug element consists of an electrically insulating material.

9. The plug-in device as claimed in claim 7, wherein the second contact portion of the electrification arrangement on the plug-in part is present on a plug-in part plug element, and wherein the plug-in part plug element consists of an electrically insulating material.

10. The plug-in device as claimed in claim 1, wherein at least one of the first contact point and the second contact point is a resilient contact point.

11. The plug-in device as claimed in claim 1, further comprising a positioning arrangement that acts between the receptacle of the socket and the plug-in portion of the plug-in part, whereby a predefined position between the plug-in portion of the plug-in part and the socket is established in a circumferential direction with respect to the plug-in axis.

12. The plug-in device as claimed in claim 1, further comprising magnet mechanisms that increase a retaining force in the connected state of the plug-in device.

13. An arrangement for goods display having a plug-in device as claimed in claim 1.

14. The plug-in device as claimed in claim 1, wherein the second contact portion of the electrification arrangement on the plug-in portion can be plugged on a plug-in part of a plug element.

* * * * *